United States Patent [19]

Simson

[11] 4,410,018

[45] Oct. 18, 1983

[54] NOZZLE STRUCTURE FOR A WEAVING MACHINE

[75] Inventor: Dionizy Simson, Winterthur, Switzerland

[73] Assignee: Sulzer Brothers Limited, Winterthur, Switzerland

[21] Appl. No.: 296,647

[22] Filed: Aug. 27, 1981

[30] Foreign Application Priority Data

Sep. 9, 1980 [EP] European Pat. Off. ..... 80 105387.7

[51] Int. Cl.[3] ..... D03D 47/34; D03D 47/36; D03D 47/28

[52] U.S. Cl. ..... 139/450; 139/435; 139/452; 226/97; 226/118

[58] Field of Search ..... 139/450, 435, 452; 226/91, 97, 118; 28/272

[56] References Cited

U.S. PATENT DOCUMENTS 3,465,939 9/1969 Van Mullekom ..... 139/435 X
3,502,253 3/1970 Van Mullekom ..... 139/452
3,675,687 7/1972 Vermeulen ..... 139/452
4,102,362 7/1978 Tojo ..... 139/435

FOREIGN PATENT DOCUMENTS 508074 7/1971 Switzerland ..... 139/450
562346 5/1975 Switzerland ..... 139/452

*Primary Examiner*—James Kee Chi
*Attorney, Agent, or Firm*—Kenyon & Kenyon

[57] ABSTRACT

The nozzle structure has a control valve in which a channel for the admission of air opens at an acute angle into the guide channel for a weft thread for a weaving machine. The channel can be adjusted so that the admitted air is directed for deceleration of the thread counter to the insertion direction. The control valve can be rotated 180° so that the admission channel is in an opposite position so that the admitted air then flows in the insertion direction of the weft thread and can be used for threading a broken weft thread into the nozzle structure.

4 Claims, 5 Drawing Figures

NOZZLE STRUCTURE FOR A WEAVING MACHINE

This invention relates to a nozzle structure for a weaving machine.

Heretofore, various types of weaving machines have been constructed which employ a nozzle structure for inserting a weft thread into a shed. For example, as described in Swiss Pat. No. 462,061, one known nozzle structure employs a guide channel for a filamentary material and a pair of air admission channels for introducing a fluid jet. In addition, the air channels are alternately connected to a compressed air feed line via a control valve and one channel is disposed in the direction of yarn travel within the guide channel while the other is disposed in the opposite direction. This structure can thus be used as a deceleration nozzle for a yarn or, for example, in the case of a yarn break, for inserting the yarn into the guide channel after the air channels have been switched.

However, this known structure can be connected only to a single air feed line. If the nozzle structure is to be used during weaving as a deceleration nozzle and for threading, for example, after a yarn rupture, this single air feed line must be fed directly from a compressed air system of the weaving machine. This is necessary in order that, even after stoppage of the weaving machine and the closing of a machine main valve coupled therewith, air will be available for the insertion of a broken weft yarn into the deceleration nozzle. Because of this, air losses are inevitable upon stoppage of the weaving machine.

Accordingly, it is an object of the invention to provide a nozzle structure capable of switching operations with a minimum of air loss.

It is another object of the invention to provide a nozzle structure for a weaving machine which is of relatively simple construction.

It is another object of the invention to provide a nozzle structure for controlling the passage of a filamentary material which can be efficiently operated.

Briefly, the invention provides a nozzle structure for a weaving machine which is comprised of a body having a guide channel for passage of a filamentary material therethrough and a control valve having a fluid channel therein for introducing a jet of fluid into the guide channel. In addition, the control valve is rotatably mounted in the body for movement between two positions in communication with the guide channel and in opposition to each other whereby the jet of fluid can be introduced alternately into the guide channel in opposite directions.

The rotatable arrangement of the fluid channel makes the construction especially simple. In this case, as a rule, a single seal may be made between the rotatable control valve and the body of the nozzle structure. Further, the fluid, for example an air jet, can be admitted into the guide channel always at approximately the same point. In contrast thereto, in the previously known nozzle structures, the outlets of the two stationary air admission channels to be selectively turned on are spaced apart by a relatively large distance. As a result, the entire nozzle structure requires more space and becomes relatively costly.

The nozzle structure may also include a pair of fluid supply ducts which are disposed in alternating communication with the fluid channel. One of these supply ducts is in communication with a source of air while the other supply duct is in communication with a main control valve for a weaving machine. Thus, when the nozzle structure is to be used as a deceleration nozzle, it is possible to obtain the necessary deceleration air from the main valve of the weaving machine. When the nozzle structure is to be used for threading-in a broken yarn, air can be obtained directly from the air source. As a result, upon stoppage of the weaving machine and the closing of the main valve coupled with the machine, air is prevented from flowing out into the open due to a direct connection of the nozzle structure to the compressed air system. Air losses, therefore, can be avoided.

These and other objects and advantages of the invention will become more apparent from the following detailed description taken in conjunction with the accompanying drawings wherein:

FIG. 1 schematically illustrates a nozzle structure connected to a weaving machine in accordance with the invention;

Figure 1:
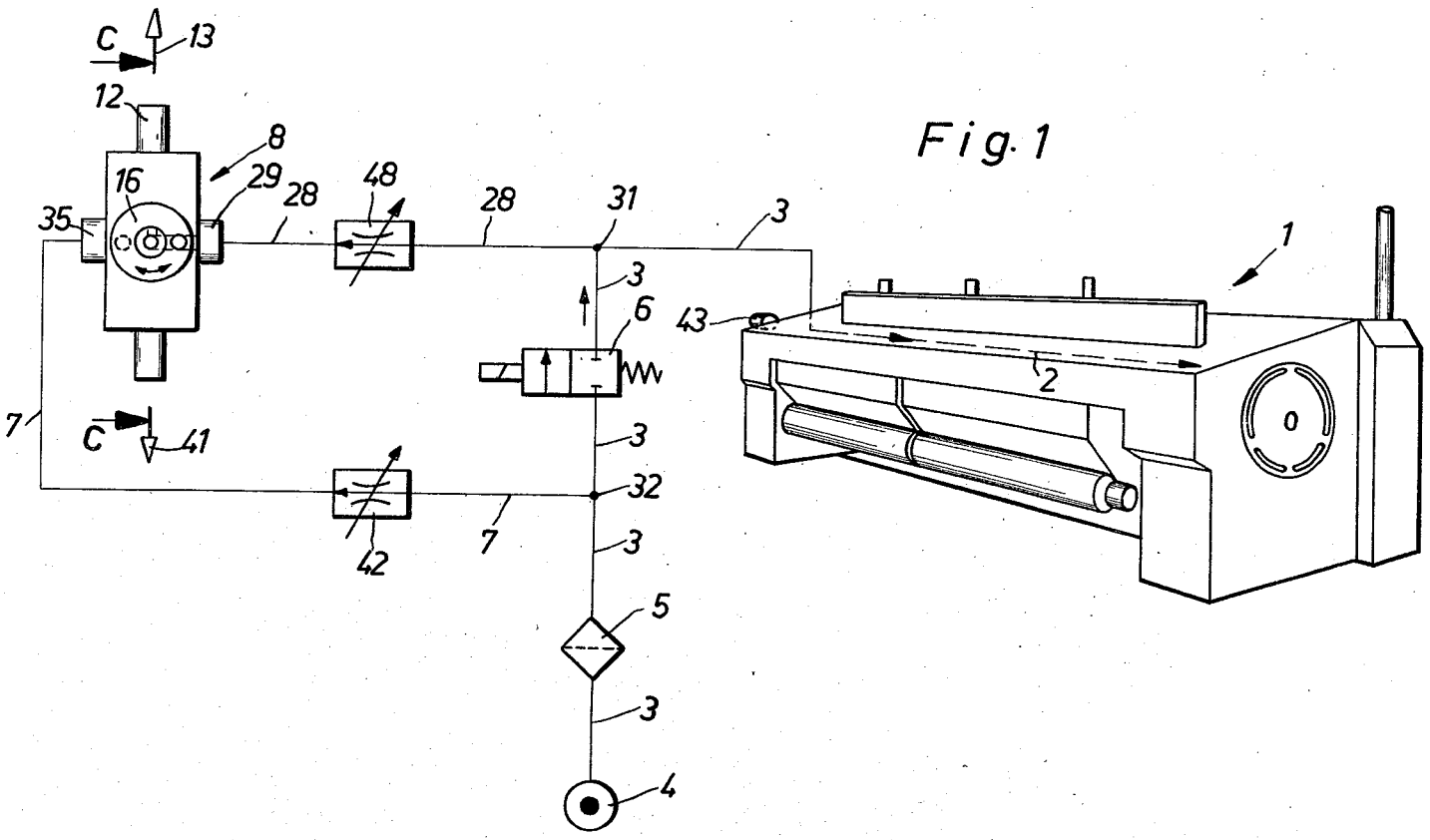

Referring to FIG. 1, a weaving machine 1, for example, of the air insertion type, is constructed so that a filamentary material, such as a weft yarn, can be inserted into a shed along the weft line 2 which is indicated in broken lines. The weaving machine 1 cooperates with one or more weft insertion nozzles (not shown) which are connected via an air feed line 3 to a compressed air source 4 of a compressed air system.

As indicated, the compressed air system has a filter 5 and a main valve 6 in the compressed air line 3. During weaving on the machine 1, all air consumers, particularly the insertion nozzles, are fed via the air feed line 3 around the open valve 6. Upon stoppage of the weaving machine 1, for instance, due to a weft yarn break, the main valve 6 is automatically closed in order to avoid air losses. The main control valve 6 thus controls the supply of air to the weaving machine 1.

As indicated in FIG. 1, a direct air supply line 7 branches from the air feed line 3 at a point 32 between the filter 5 and main control valve 6. This supply line 7 contains a throttle 42 and extends to a nozzle structure 8. In addition, a deceleration air supply line 28 branches from the air feed line 3 at a point 31 between the control valve 6 and the weaving machine 1. This air supply line 28 contains a throttle 48 and extends to the nozzle structure 8.

Figure 2:
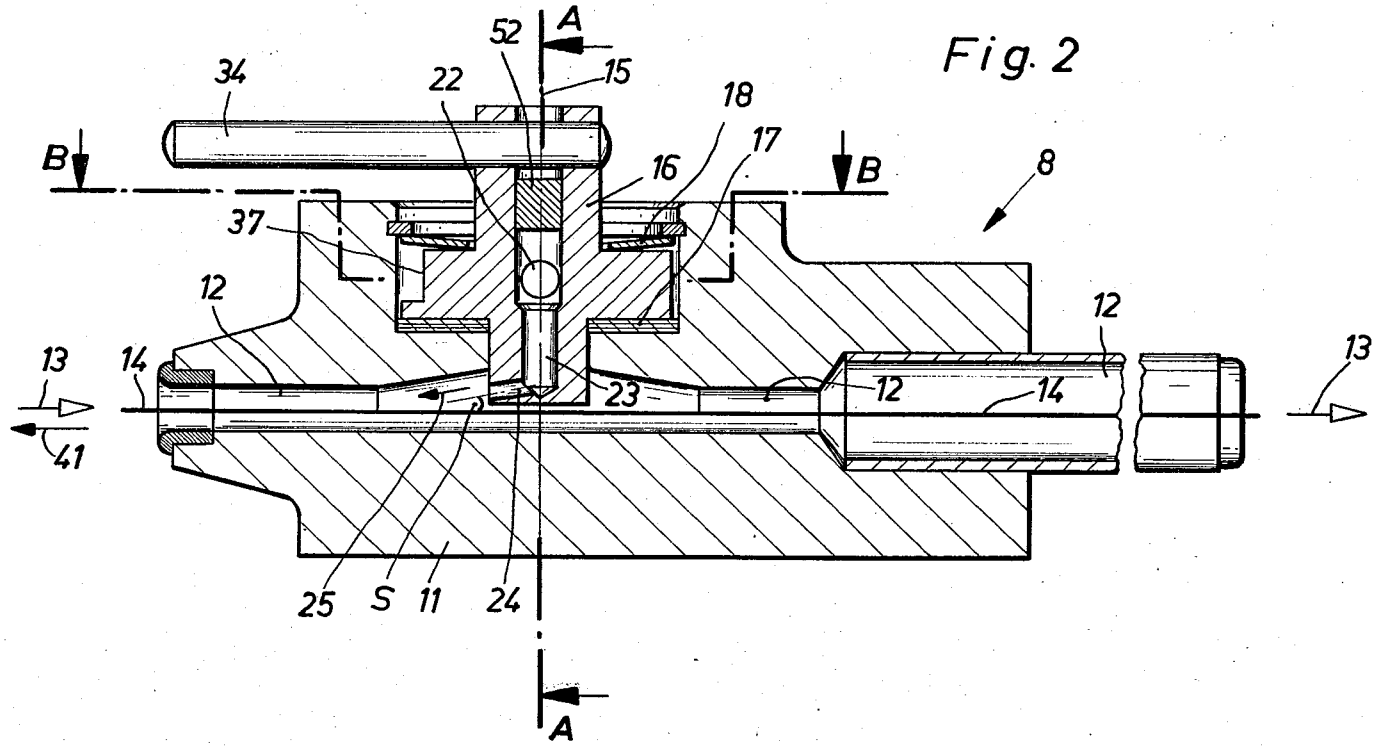
FIG. 2 illustrates a view taken on line C—C of FIG. 1.

Referring to FIG. 2, the nozzle structure 8 includes a nozzle body 11 having a guide channel 12 for guiding a weft yarn 14 therethrough for insertion in the direction indicated by the arrow 13. In addition, a control valve 16 is rotatably mounted in the body 11 about a vertical axis 15, as viewed, and is held in place via a leaf spring 18 against a seal 17 in a suitable manner. The control valve 16 has a fluid channel, i.e., an air channel for introducing a jet of air into the guide channel 12. This air channel consists of a vertical section 21 (FIG. 3), a horizontal section 22, a central vertical section 23, and an air admission section 24 which leads outwardly towards the guide channel 12 at an acute angle of, for example, 10°.

The control valve 16 is rotatable so as to move between two positions within the nozzle body 11, each of which is in communication with the guide channel 12 and in opposition to the other.

As shown in FIG. 2, the central vertical section 23 of the air channel in the control valve 16 is closed by a closure plug 52 which can be fitted in place in a suitable manner.

Figure 3:
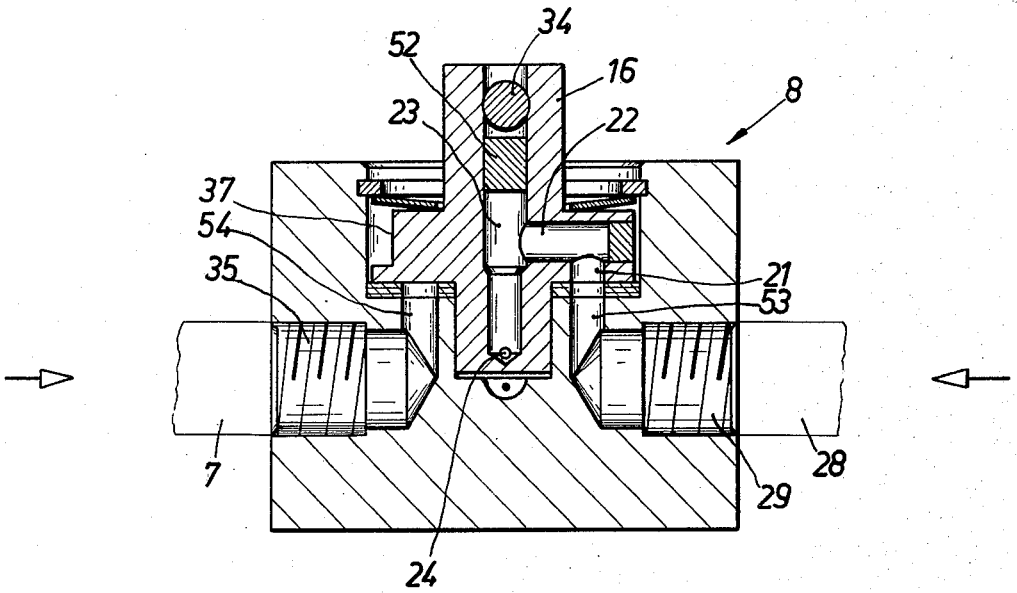
FIG. 3 illustrates a view taken on line A—A of FIG. 2.

Referring to FIG. 3, the valve body 11 contains chambers 29, 35 which are respectively connected to the air supply line 28 and air supply line 7 of the compressed air system.

Figure 5:
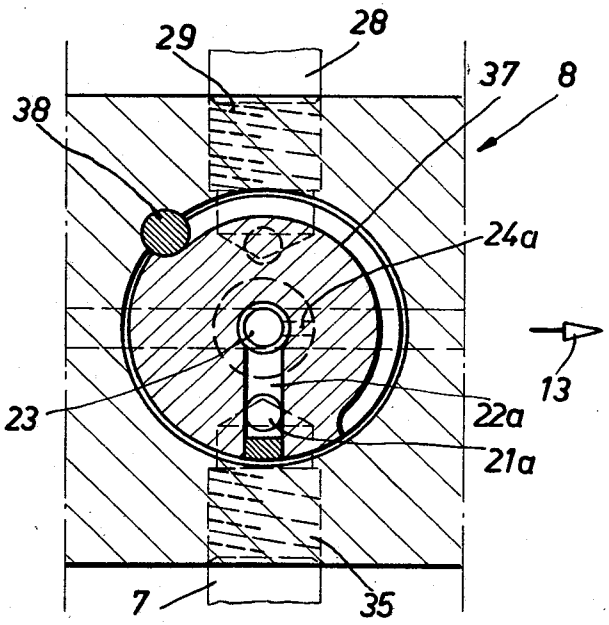
FIG. 5 illustrates a view similar to FIG. 4 with the parts of the nozzle structure in a different position.
Figure 4:
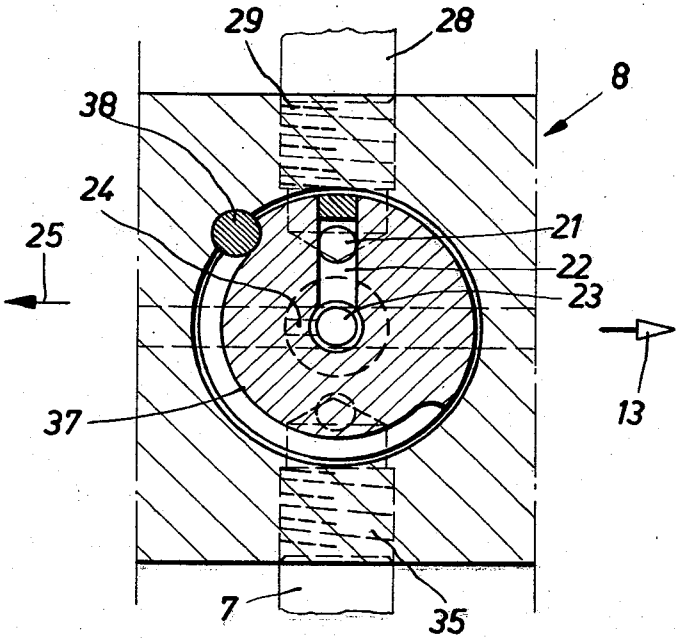
FIG. 4 illustrates a view taken on line B—B of FIG. 2.

Referring to FIGS. 4 and 5, in order to rotate the control valve 16, an annular shoulder 37 is formed on the control valve 16 to extend over an angle of approximately 180° and a fixed button or pin 38 is disposed in the body 11 to abut the respective ends of the shoulder 37. In addition, a lever 34 is secured in a projecting portion of the control valve 16 as indicated in FIG. 2.

In operation, while the weaving machine 1 is operating, the nozzle structure 8 is in the deceleration position indicated in FIGS. 2 and 4. At this time, the main control valve 6 is open (FIG. 1) and air flows via the lines 3, 28 and air admission section 24 as indicated by the arrows 25, 41 (FIG. 2) in the opposite direction to the travel of the weft yarn 14. The weft yarn 14 is therefore subjected to a gentle permanent braking action or tension by the admitted deceleration air. In this way, the weft yarn 14 can be held in abutment on a thread-proportioning drum 43 disposed on the picking side of the weaving machine 1. (See FIG. 1).

If, for example, a weft yarn breakage occurs in the weaving machine, the machine is stopped and the main valve 6 is closed automatically. At this time, the control valve 16 is pivoted 180° by means of the lever 34 from the deceleration position shown in FIG. 4 to the threading position shown in FIG. 5. At this time, the direct air feed line 7 (see FIG. 1) is connected to the nozzle structure 8. Thus, the channel sections 21, 22 are in the positions 21*a*, 22*a* of FIG. 5 so that air is conveyed from the compressed air line 3 via the branch point 32 and line 7 directly from the compressed air source 4 into the nozzle structure 8. The air is then guided into the guide channel 12 in the direction of the weft insertion (arrow 13). Thus, the broken weft yarn can be threaded into the nozzle structure 8 or the yarn channel 12. In so doing, the yarn is sucked into the channel 12 from the left as viewed in FIG. 2 and supplied to the further parts of the machine for weft insertion.

It is to be noted that during a weaving operation, the nozzle structure 8 receives air from the compressed air line 3 via the branch point 31. Thus, upon a weft yarn breakage and stoppage of the weaving machine 1, the air supplied to the nozzle structure 8 is shut off immediately upon closing of the main control valve 6.

In order to thread the weft yarn into the nozzle 8, the nozzle 8 is switched into the position shown in FIG. 5 so that the air is drawn directly from the compressed air source 4. This occurs only for threading and occurs only for the time of threading. When threading has taken place, and the weaving operation is resumed, the nozzle structure 8 is reset by means of the lever 34 from the position shown in FIG. 5 into the position shown in FIG. 4. At this time, the supplied weft yarn can again be maintained continuously under tension at the proportioning drum 43 during operation.

In an alternative construction, the air feed line 28 can be eliminated. In this embodiment, the nozzle structure 8 contains only the pivotal control valve 16 with the air admission section 24 and air is supplied solely via the air feed line 7 directly from the compressed air source 4. Alternatively, the guide channel 12 may be taken off at an angle, for example, at the axis 15.

In another embodiment, the closure plug 52 can be omitted and the hand lever 34 clamped onto the control valve 16, for example, from the outside.

In another embodiment where the air feed line 28 is omitted, the air feed line 7 is connected to the central vertical section 23 at the top so that the air to be supplied is introduced on this path. Further, in this case, the connecting channels 29, 35 in the nozzle body 11 are also eliminated.

Of note, instead of using air, another fluid, such as water, can be used. This may be of consideration, especially for water jet weaving machines.

What is claimed is:

1. A nozzle structure for a weaving machine comprising a body having a guide channel passing therethrough for passage of a filamentary material therethrough; and a control valve having a fluid channel therein for introducing a jet of fluid into said guide channel, said valve being rotatably mounted in said body on an axis perpendicular to said guide channel for movement between two positions in communication with said guide channel and in opposition to each other whereby the jet of fluid can be introduced alternately into said guide channel in opposite directions.

2. A nozzle structure as set forth in claim 1 wherein said body further includes a pair of fluid supply ducts disposed in alternating communication with said fluid channel.

3. In combination, a weaving machine;

a compressed air system for feeding air to said weaving machine, said system including a source of air and a control valve for controlling the supply of air from said source to said machine; and a nozzle structure including a body having a guide channel for passage of a filamentary material therethrough, a second control valve having a fluid channel for introducing a jet of fluid into said guide channel, said second control valve being rotatably mounted in said body for movement between two positions in communication with said guide channel in opposition to each other, and a pair of supply ducts disposed in alternating communication with said fluid channel, one of said supply ducts being in communication with said source of air and the other of said supply ducts being in communication with said first control valve.

4. In combination, a weaving machine;

a compressed air system for feeding air to said weaving machine, said system including a source of air and a control valve for controlling the supply of air from said source to said machine; and a nozzle structure including a body having guide channel for passage of a filamentary material therethrough, a second control valve having a fluid channel in communication with said source of air for introducing a jet of fluid into said guide channel, said second control valve being rotatably mounted in said body on an axis perpendicular to said guide channel for movement between two positions in communication with said guide channel and in opposition to each other.

* * * * *